US007804463B2

(12) United States Patent
Degner et al.

(10) Patent No.: US 7,804,463 B2
(45) Date of Patent: Sep. 28, 2010

(54) ANTENNA-CARRYING ASSEMBLY

(75) Inventors: Brett William Degner, Menlo Park, CA (US); Chris Ligtenberg, San Carlos, CA (US); Bartley K. Andre, Menlo Park, CA (US); Douglas B. Kough, San Jose, CA (US)

(73) Assignee: Apple Inc., Cupertino, CA (US)

( * ) Notice: Subject to any disclaimer, the term of this patent is extended or adjusted under 35 U.S.C. 154(b) by 615 days.

(21) Appl. No.: 11/835,944

(22) Filed: Aug. 8, 2007

(65) Prior Publication Data

US 2009/0040129 A1 Feb. 12, 2009

(51) Int. Cl.
*H01Q 1/12* (2006.01)

(52) U.S. Cl. ..... 343/878; 343/700 MS; 343/702; 343/895

(58) Field of Classification Search ..... 343/700 MS, 343/702, 878, 895; 235/441, 449, 451, 492, 235/472.01, 472.03
See application file for complete search history.

(56) References Cited

U.S. PATENT DOCUMENTS 5,410,325 A 4/1995 Friedrich et al.
5,779,496 A * 7/1998 Bolinger et al. ..... 439/377
5,834,756 A * 11/1998 Gutman et al. ..... 235/493
5,841,122 A * 11/1998 Kirchhoff ..... 235/492
6,344,825 B1 * 2/2002 Wong ..... 343/702
6,618,013 B1 * 9/2003 Aldous ..... 343/702
7,068,238 B2 6/2006 Yoneya et al.
7,114,652 B2 * 10/2006 Moullette et al. ..... 235/449
7,129,906 B2 10/2006 Yoneya et al.
7,486,165 B2 * 2/2009 Ligtenberg et al. ..... 335/205
7,701,400 B2 * 4/2010 Su et al. ..... 343/702
2007/0218837 A1 * 9/2007 Lessing et al. ..... 455/41.2

* cited by examiner

*Primary Examiner*—Douglas W Owens
*Assistant Examiner*—Chuc D Tran

(57) ABSTRACT

An antenna-carrying assembly for facilitating wireless communication using an electronic device is disclosed. The antenna-carrying assembly may include a body and one or more antenna elements carried by the body. The antenna-carrying assembly may also include a first attraction element carried by the body. The first attraction element is configured to magnetically couple the antenna-carrying assembly with a track and to slide along the track. At least one of the first attraction element and the track includes one or more magnetic elements.

30 Claims, 7 Drawing Sheets

ANTENNA-CARRYING ASSEMBLY

BACKGROUND OF THE INVENTION

An electronic device, such as a portable electronic device, may be equipped with one or more antennas configured for facilitating wireless communication based on one or more standards such as, for example, Wi-Fi, WiMAX, GPRS, WCDMA, CDMA2000, etc. The antenna may be supported by an antenna-carrying assembly. Typically, there are two types of antenna-carrying assemblies: add-on antenna-carrying assemblies and built-in antenna carrying assemblies.

A typical add-on antenna-carrying assembly may be represented by a PC card antenna-carrying assembly. A PC card antenna-carrying assembly may have a PC card configuration and may be inserted into a PC card slot of an electronic device, such as a notebook computer or PDA. Generally, a significant portion of the PC card antenna-carrying assembly may protrude from the enclosure of the electronic device for reception and transmission of electromagnetic signals (or RF signals).

The protrusion may cause significant inconvenience associated with the use of the electronic device. For example, a user of the electronic device may have to remove the PC card antenna-carrying assembly before the electronic device can be stowed or transported in a case or bag. Further, the PC card antenna-carrying assembly and the electronic device may be disposed separately when the electronic device is stowed or transported. As a result, the PC card antenna-carrying assembly may not be available when wireless communication is needed. If the PC card antenna-carrying assembly is not removed from the electronic device, the protrusion may increase the likelihood of damage to the PC card antenna-carrying assembly or the electronic device during transportation.

A typical built-in antenna-carrying assembly may represent a rotatable part of an electronic device. In general, a built-in rotatable antenna-carrying assembly may be mechanically coupled with an enclosure of an electronic device through a pivot mechanism. The rotatable antenna-carrying assembly may be rotated to a deployed position for reception and transmission of electromagnetic signals, and may be rotated to a stowed position when not in use.

The rotatable antenna-carrying assembly may represent a protrusion outside the enclosure of the electronic device. If the rotatable antenna-carrying assembly and the pivot mechanism are not sufficiently reinforced, the rotatable antenna-carrying assembly and/or the pivot mechanism may be prone to damage. If the rotatable antenna-carrying assembly or the pivot mechanism is damaged, repair/replacement of the rotatable antenna-carrying assembly or the pivot mechanism may be inconvenient or event difficult, given the coupling among the rotatable antenna-carrying assembly, the pivot mechanism, and the enclosure. If the rotatable antenna-carrying assembly and the pivot mechanism are to be sufficiently reinforced, significant material and manufacturing costs may be incurred.

When employed with a notebook computer, a prior art antenna-carrying assembly, such, as a PC card antenna-carrying assembly or a rotatable antenna-carrying assembly, may generally be disposed at the base unit of the notebook computer. Accordingly, the antenna may be positioned close to the table on which the notebook is placed. As a result, electromagnetic signals may be obstructed by the table, and the efficiency of signal reception and transmission may be suboptimal.

Further, if the notebook computer has a metal enclosure that is opaque to electromagnetic waves, given that the antenna is disposed at the base unit, electromagnetic signals may be further blocked by the metal enclosure of the display module of the notebook computer. As a result, the efficiency of signal reception and transmission may be further compromised. In order to mitigate the problem, manufacturers may need to avoid metal materials when designing notebook computer enclosures.

SUMMARY OF INVENTION

An embodiment of the present invention is an antenna-carrying assembly for facilitating wireless communication using an electronic device. The antenna-carrying assembly may include a body and one or more antenna elements carried by the body. The antenna-carrying, assembly may also include a first attraction element carried by the body. The first attraction element is configured to magnetically couple the antenna-carrying assembly with a track and to slide along the track. At least one of the first attraction element and the track includes one or more magnetic elements.

The above summary relates to only one of the many embodiments of the invention disclosed herein and is not intended to limit the scope of the invention, which is set forth is the claims herein. These and other features of the present invention will be described in more detail below in the detailed description of the invention and in conjunction with the following figures.

BRIEF DESCRIPTION OF THE DRAWINGS

The present invention is illustrated by way of example, and not by way of limitation in the figures of the accompanying drawings and in which like reference numerals refer to similar elements and in which.

DETAILED DESCRIPTION OF EMBODIMENTS

Figure 1A:
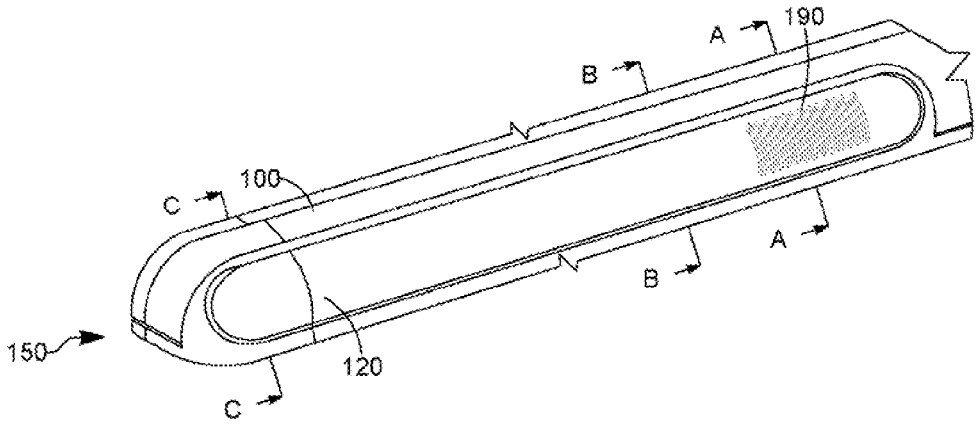
FIG. 1A illustrates a partial perspective view of an electronic device with an antenna-carrying assembly (boom assembly) in a stowed state in accordance with one or more embodiments of the present invention.

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

One or more embodiments of the invention relate to an antenna-carrying assembly (e.g., a boom assembly) for facilitating wireless communication employing an electronic device. The antenna-carrying assembly may include a body, which may be transparent or at least not opaque to electromagnetic signals (or RF signals). The antenna-carrying assembly may, also include one or more antenna elements (e.g., a flex antenna) carried by the body. The antenna-carrying assembly may further include a first attraction element carried by the body. The first attraction element may be configured to magnetically couple the antenna-carrying assembly with a track and to slide along the track.

At least one of the first attraction element and the track may include one or more magnetic elements or one or more ferrous elements. In one or more embodiments, each of the first attraction element and the track may include one or more magnetic elements. A magnetic element may include one or more magnets or Halbach arrays with one or more directed/tuned magnetic fields.

The track may be disposed along an edge of the electronic device. The track may include a plurality of discretely distributed attraction elements configured to tune tactile feedback, such as resistance, bumps, or variations of resistance or bumps, perceived by a user of the electronic device.

Alternatively or additionally, the track may be disposed in a mating structure (e.g., a trench) configured to accommodate the antenna-carrying assembly. The mating structure may be part of a module, e.g., a display module, of the electronic device. A substantial portion of the antenna-carrying assembly may be flush with at least a portion of an outer surface of an enclosure of the electronic device when the antenna-carrying assembly is in a stowed state.

The antenna-carrying assembly may also include a second attraction element carried by the body. The second attraction element may be configured to magnetically couple a tip of the antenna-carrying assembly with an electrical contact of the electronic device when the antenna-carrying assembly in a stowed state. The second attraction element may ensure the tip remain flush with a surface of an enclosure of the electronic device. The second attraction element may also prevent or at least reduce warping of the antenna-carrying assembly.

The antenna-carrying assembly may also include one or more tap elements electrically coupled with the one or more antenna elements and configured to electrically couple the one or more antenna elements to one or more electrical contacts of the electronic device when the antenna-carrying assembly has slid to a deployed state. At least one of the one or more tap elements and the one or more electrical contacts of the electronic device may be configured to produce an acoustic/tactile signal, e.g., a "click", when the one or more antenna elements are coupled to the one or more electrical contacts of the electronic device. The one or more tap elements may be configured to stop the antenna-carrying assembly from sliding in at least one direction. The one or more tap elements may represent a plurality of tap elements (or feed points) for multi-band communication. The one or more tap elements may have a stud configuration.

The antenna-carrying assembly may also include an insert-molded shunt element carried by the body. The inserted-molded shunt may be configured to augment/tune a magnetic field of the first attraction element. The inserted-molded shunt may also be configured to secure the first attraction element in place though magnetic coupling. Accordingly, the first attraction element may, be dropped into and secured in a holding structure (or slot structure) of the body without relying on a fastening mechanism (e.g., a screw) or structure (e.g., a dovetail or groove). The holding structure may also be configured to limit movement of the antenna-carrying assembly relative to the track.

The antenna-carrying assembly may also include a tactile feature (e.g., a grid or ridge feature) configured to enable the antenna-carrying assembly to be slid by a user of the electronic device without being seen by the user.

One or more embodiments of the invention relate to an electronic device. For example, the electronic device may represent one or more of a computing device (e.g., a computer), a computer peripheral (e.g., a display), a communication device (e.g., a cellular phone), a media player (e.g., an MP3 player), etc.

The electronic device may include the aforementioned antenna-carrying assembly and track. The electronic device may also include a label/coating disposed on at least one of the track and the first attraction element and configured to tune friction between the track and the first attraction element.

The electronic device may also include one or more walls configured to stop the antenna-carrying assembly from moving in a particular dimension. The electronic device may also include a tether connected to the antenna-carrying assembly and configured to limit movement of the antenna-carrying assembly when the antenna-carrying assembly breaks away (or is detached) from a mating portion of the electronic device.

The features and advantages of the present invention may be better understood with reference to the figures and discussions (with prior art mechanisms and embodiments of the invention contrasted) that follow.

FIG. 1A illustrates a partial perspective view of an electronic device 150 with an antenna-carrying assembly 120 (boom assembly 120) in a stowed state in accordance with one or more embodiments of the present invention. Antenna-carrying assembly 120 may be disposed along an edge of an enclosure 100 of electronic device 150. Antenna-carrying assembly 120 may include tactile feature 190 configured to encourage and guide a user of electronic device 150 to slide antenna-carrying assembly 120 along the edge of enclosure 100. Advantageously, the user can operate antenna-carrying assembly 120 without seeing antenna-carrying assembly 120.

Partial cross-sectional views A, B, and C of electronic device 150 will be discussed with reference to FIGS. 4A-C.

Figure 1B:
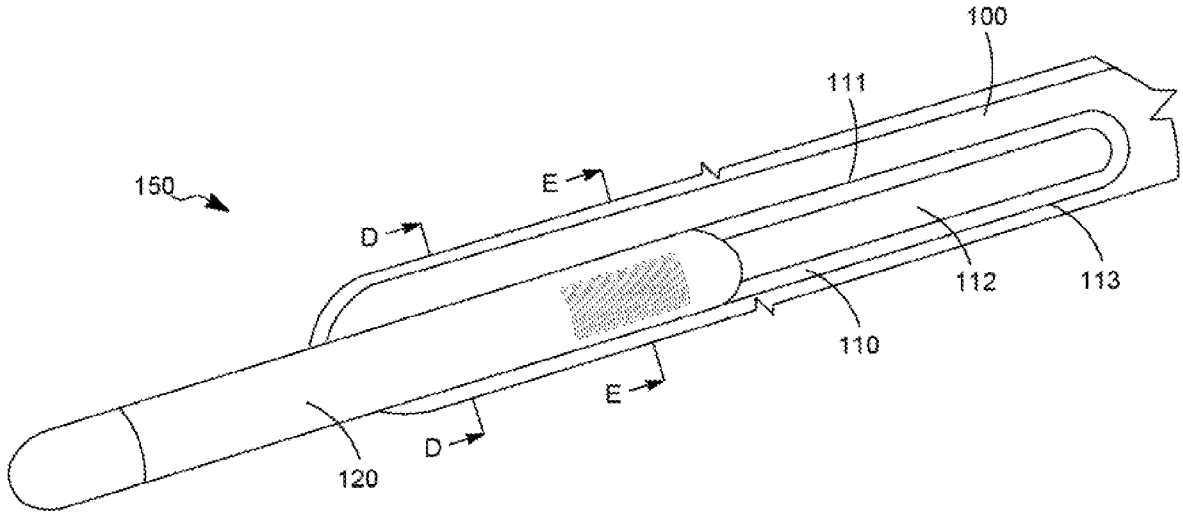
FIG. 1B illustrates a partial perspective view of the electronic device of the example of FIG. 1A with the antenna-carrying assembly in a deployed state in accordance with one or more embodiments of the present invention.

FIG. 1B illustrates a partial perspective view of electronic device 150 with antenna-carrying assembly 120 in a deployed state in accordance with one or more embodiments of the present invention. In the deployed state, antenna-carrying assembly 120 may have an adequate separation from enclosure 100 such that the transmission and/or reception efficiency of signals (e.g., electromagnetic signals) may be maximized.

Antenna-carrying assembly 120 may be accommodated by a mating structure 110 (or trench 110) in a stowed state. Antenna-carrying assembly 120 may be guided by at least one of track 112 and one or more of walls 111 and 113 of mating structure 110 when translating from the stowed state illustrated in the example of FIG. 1A to a deployed state shown in the example of FIG. 1B. Track 112 may include an attraction element made of a magnetic or ferrous material for magnetically securing and guiding Antenna-carrying assembly 120. Track 112 may also include a label/coating or may be covered by a label/coating for cosmetic/aesthetic and tactile effects.

Partial cross-sectional views E and D of electronic device 150 will be discussed with reference to FIGS. 4A and 4D, respectively.

Figure 2:
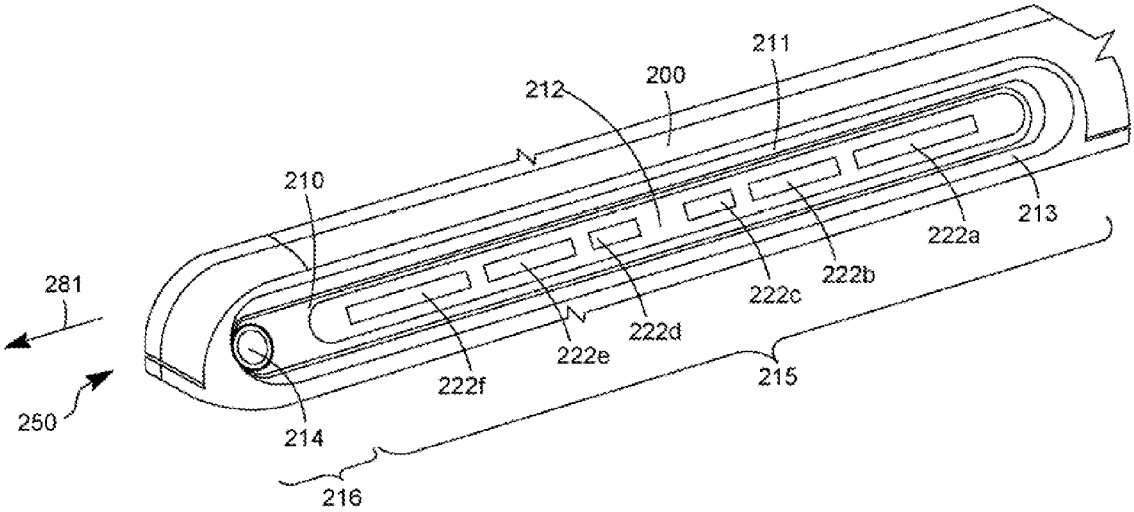
FIG. 2 illustrates a perspective view of mating structure of an electronic device for accommodating an antenna-carrying assembly in accordance with one or more embodiments of the present invention.
Figure 3:
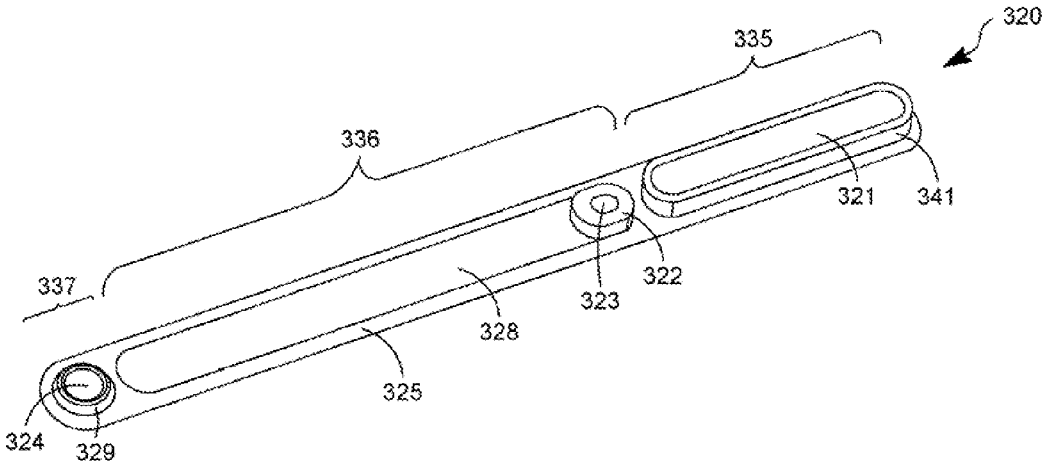
FIG. 3 illustrates a perspective view of an antenna-carrying assembly (or boom assembly) in accordance with one or more embodiments of the present invention.

FIG. 2 illustrates a perspective view of mating structure 210 of an electronic device 250 for accommodating an antenna-carrying assembly (such as antenna-carrying assembly 320 illustrated in the example of FIG. 3) in accordance with one or more embodiments of the present invention. Mating structure 210 section may include an electrical section 216 and a magnetic section 215.

Electrical section 216 may include electrical contact 214. Electrical contact 214 may be configured to conduct electrical signals between one or more antennas carried by the antenna-carrying assembly and circuitry inside electronic device 250. Electrical contact 214 may have a configuration with one or more of a ball detent, a rounded pin, a cantilever contact, and a pogo pin. Electrical contact 214 may include one or more magnetic/ferrous elements and may provide magnetic coupling in addition to electrical coupling, for securing a tip of the antenna-carrying assembly in place when the antenna-carrying assembly is in a stowed state or to augment the contact force when electrically coupled in the deployed state.

Magnetic section 215 may include track 212 for securing and guiding the antenna-carrying assembly. Track 212 may include one or more attraction elements 222*a-f* configured to magnetically couple with the antenna-carrying assembly. The one or more attraction elements 222*a-f* may also be configured to guide movement of the antenna-carrying assembly.

The one or more attraction elements 222*a-f* may be discretely distributed along track 212 to provide tactile feedback, such as resistance, bumps, or variation of resistance or bumps, to a user of electronic device 250. Alternatively or additionally, the one or more attraction elements 222*a-f* may represent one continuous attraction plate.

The one or more attraction elements 222*a-f* may be tuned to guide the antenna-carrying assembly to move along the center line of track 212. Alternatively or additionally, the one or more attraction elements 222*a-f* may be tuned to bias the antenna-carrying assembly towards at least one of wall 211 and wall 213, such that the antenna-carrying assembly may move along at least one of walls 211 and 213.

The one or more attraction elements 222*a-f* may include one or more magnetic elements. The one or more magnetic elements may include one or more Halbach arrays. The one or more attraction elements 222*a-f* may include one or more ferrous elements, such as a steel plate.

FIG. 3 illustrates a perspective view of an antenna-carrying assembly 320 (or boom assembly 320) in accordance with one or more embodiments of the present invention. Antenna-carrying assembly 320 may be accommodated by mating structure 210 in a stowed state and may move along mating structure 210 between the stowed state and a deployed state similar to the deployed state illustrated in the example of FIG. 1B. Antenna-carrying assembly 320 may include a first magnetic section 335, an antenna section 336, and a second magnetic section 337.

First magnetic section 335 may include a first attraction element 321 disposed in a holding structure 341 of a body 325 of antenna-carrying assembly 320. First attraction element 321 may be configured to magnetically couple antenna-carrying assembly 320 to a track, such as track 212 illustrated in the example of FIG. 2. First attraction element 321 may also be configured to slide/translate along track 212.

First attraction element 321 may include one or more magnetic and/or ferrous elements. The one or more magnetic elements may include one or more Halbach arrays. First attraction element 321 may be tuned to center first attraction element 321 along a center line of track 212. Alternatively or additionally, first attraction element 321 may be tuned to bias holding structure 341 against one or more walls of mating structure, such as one or more of walls 211 and 213 illustrated in the example of FIG. 2.

Holding structure 341 may be configured to substantially limit movement of antenna-carrying assembly 320 to translation along mating structure 210 and break away from mating structure 210.

Antenna section 336 may include one or more antenna elements 328 carried by body 325. Body 325 may be formed of a material, such as plastic, that is not opaque to electromagnetic signals. The one or more antenna elements 328 may be configured to transmit and/or receive electromagnetic signals. The one or more antenna elements 328 may include a label/coating or may be covered by a label/coating, for protection and cosmetics/aesthetics.

Antenna section 336 may also include one or more tap elements, such as tap element 322. Tap element 322 may be electrically coupled to an electrical contact, such as electrical contact 214 illustrated in the example of FIG. 2, when antenna-carrying assembly 320 is in a deployed state, such that an electrical path between circuitry inside an electronic device, such as electronic device 250 illustrated in the example of FIG. 2, and the one or more antenna elements 328 may be established.

Tap element 322 may include a mating feature 323 configured to engage electrical contact 214. When antenna-carrying assembly 320 slides into the deployed state, i.e., when tap element 322 is coupled to electrical contact 214, at least one of tap element 322 and electrical contact 214 may produce an acoustic and/or tactile signal, such as a click. Advantageously, the user may confirm that antenna-carrying assembly 320 is in the deployed state without looking at antenna-carrying assembly 320.

Tap element 322 may have a stud configuration. Tap element 322 may be configured to limit movement of antenna-carrying assembly 320 when antenna-carrying assembly 320 has been in the deployed state. For example, by contacting an end of a mating structure, such as mating structure 210 illustrated in the example of FIG. 2, tap element 322 may stop antenna-carrying assembly 320 from further sliding in a direction 281 shown in the example of FIG. 2.

Second magnetic section 337 may represent a tip portion of antenna-carrying assembly 320. Second magnetic section 337 may include a second attraction element 324 having one or more magnetic and/or ferrous elements and configured to magnetically couple to electrical contact 214 when antenna-carrying assembly is in a stowed state. Second magnetic section 327 may also include a rib structure 329 surrounding second attraction element 324 configured to fit with an end portion of a mating structure, such a mating structure 210 illustrated in the example of FIG. 2.

With magnetic coupling between electrical contact 214 and second attraction element 324 and between track 212 and first attraction element 321, antenna-carrying assembly 320 may be secured, e.g., in mating structure 210 shown in the example of FIG. 2, in the stowed state. An outer surface of antenna-carrying assembly 320 may be flush with an outer surface of enclosure 200 of electronic device 250. As a result, antenna-carrying assembly may be smoothly integrated with enclosure 200. Advantageously, electronic device 250 may be conveniently stowed and transported, and aesthetic/cosmetic design requirements of electronic device 250 may also be satisfied. Further, the magnetic coupling between 327 and electrical contact 214 may prevent antenna-carrying assembly 320 from warping.

The utilization of magnetic coupling may also facilitate break-away of antenna-carrying assembly 320 when antenna-carrying assembly 320 is not in the stowed state and when an undesirable force is applied to antenna-carrying assembly 320. Advantageously, the break-away may prevent damage to antenna-carrying assembly 320 and electronic device 250. Magnetic coupling may also allow for modular antenna-carrying assemblies, e.g. assemblies specifically optimized for different wireless standards. Further, the utilization of magnetic coupling may also facilitate easy replacement of antenna-carrying assembly 320.

Figure 4A:
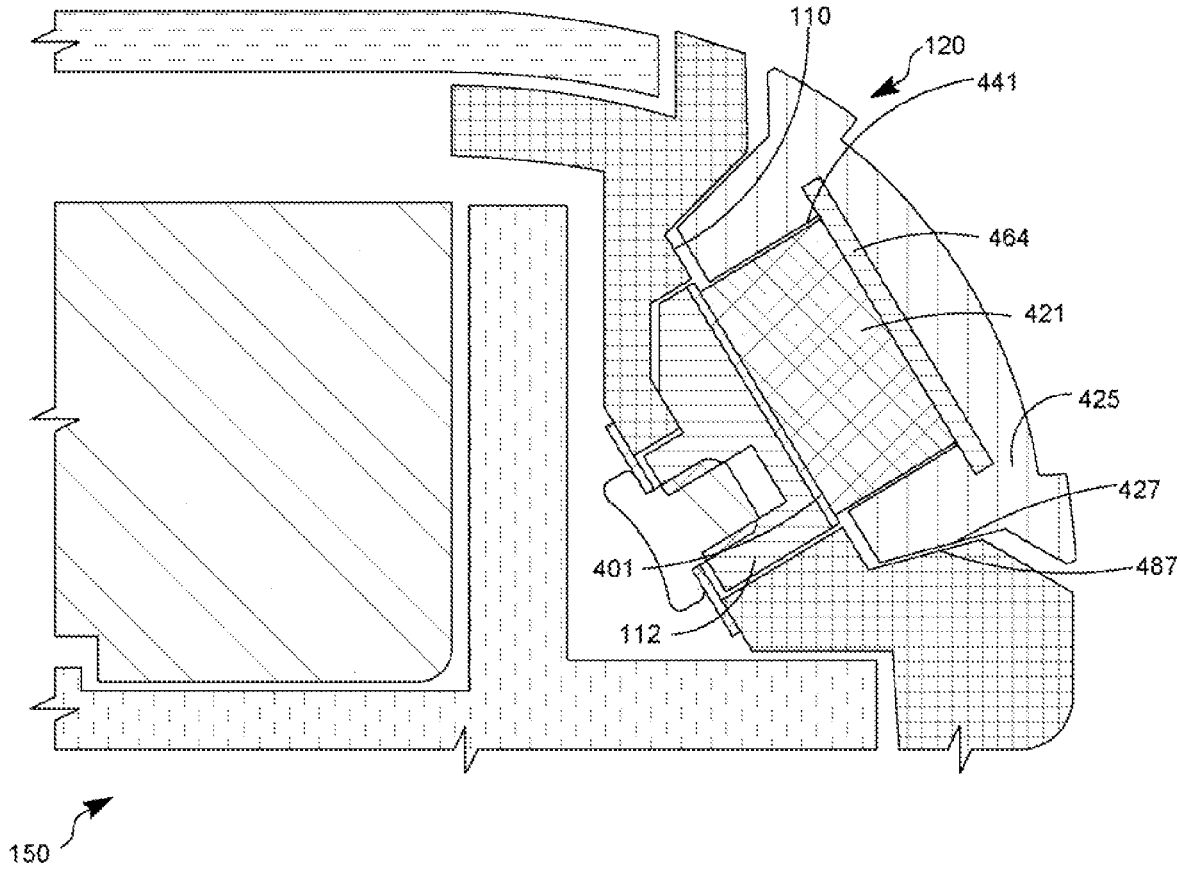
FIG. 4A illustrates a partial cross-sectional view of an electronic device in accordance with one or more embodiments of the present invention.

FIG. 4A illustrates a partial cross-sectional view of electronic device 150 shown in the examples of FIG. 1A and FIG. 1B in accordance with one or more embodiments of the present invention. The example of FIG. 4A may represent cross-sectional view A indicated in the example of FIG. 1A or cross-sectional view E indicated in the example of FIG. 1B. As shown in the example of FIG. 4A, electronic device 150 may include antenna-carrying assembly 120 accommodated by mating structure 110.

Antenna-carrying assembly 120 may include a shunt 464 insert-molded inside body 425 of antenna-carrying assembly 120. Shunt 464 may be configured to augment/tune the magnetic field of first attraction element 421. Shunt 464 may also be configured to secure first attraction element 421 through magnetic coupling, such that first attraction element 421 may be secured in holding structure 441 without relying on complicated fastening devices (such as a screw) or complicated fastening structures (such as a dovetail or groove). Advantageously, manufacturing of antenna-carrying assembly 120 may be simplified. Between first attraction element 421 and shunt 464, glue or adhesive may be applied to reinforce the coupling.

Body 425 may, have one or more structures, such as tapered structure 427, which may automatically fit/align with one or more structures, such as tapered structure 487 of mating structure 110. Tapered structures 427 and 487 may also allow for break-away and insertion of antenna-carrying assembly 120 from electronic device 150 in more than one direction vector.

Electronic device 150 may include label/coating 401 disposed on at least one of track 112 and first attraction element 421. Label/coating 401 may be configured to tune the friction between track 112 and first attraction element 421. Alternatively or additionally, label/coating 401 may be configured to provide cosmetic and/or tactile effects.

Figure 4B:
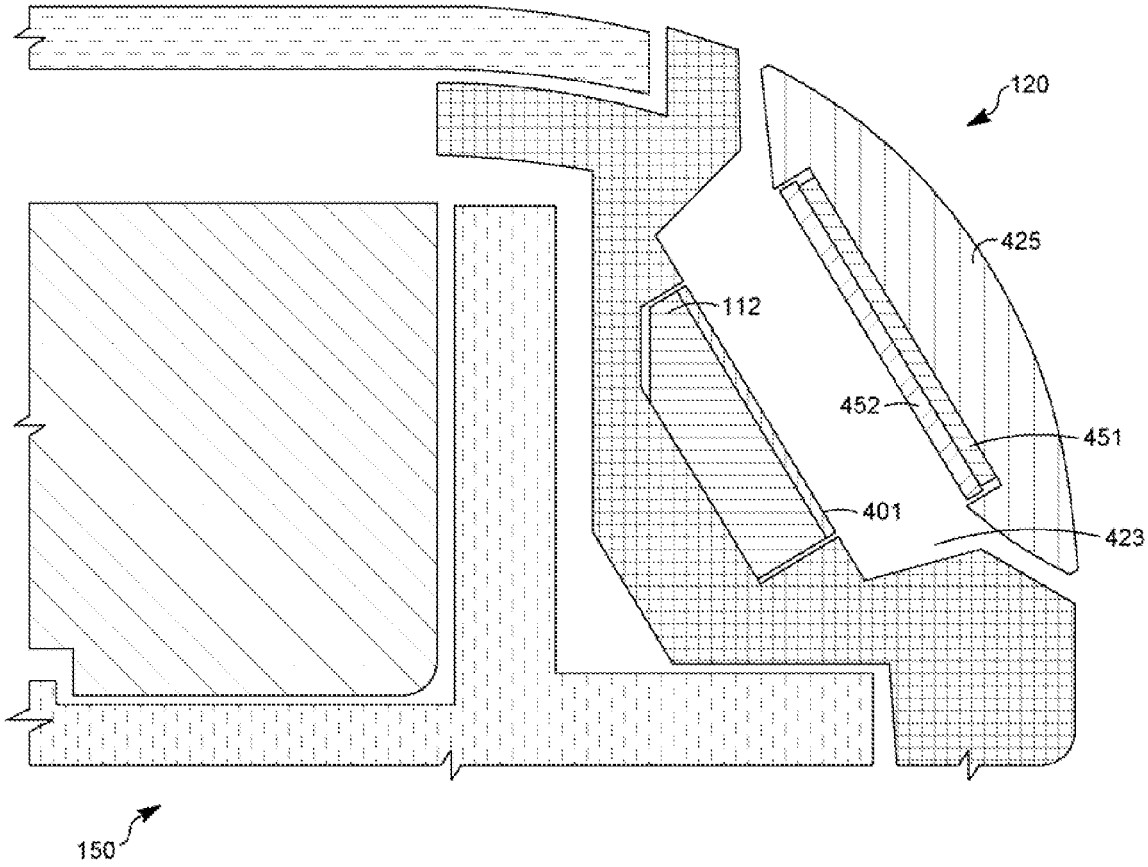
FIG. 4B illustrates a partial cross-sectional view of an electronic device with an antenna-carrying assembly in a stowed state in accordance with one or more embodiments of the present invention.

FIG. 4B illustrates a cross-sectional view of electronic device 150 with antenna-carrying assembly 120 in the stowed state illustrated in the example of FIG. 1A in accordance with one or more embodiments of the present invention. For example, FIG. 4B may represent cross-sectional view B indicated in the example of FIG. 1A. As illustrated in FIG. 4B, antenna-carrying assembly 120 may include one or more antenna elements 451 carried by body 425. Antenna-carrying assembly 120 may also include label/coating 452 configured to protect the one or more antenna elements 451 and to satisfy one or more cosmetic/aesthetic design requirements.

Electronic device 150 may further include a space 423 between track 112 (or label/coating 401) and antenna-carrying assembly 120 such that friction exerted on antenna-carrying assembly 120 may be minimized during translation/movement of antenna-carrying assembly 120 relative to electronic device 150.

Figure 4C:
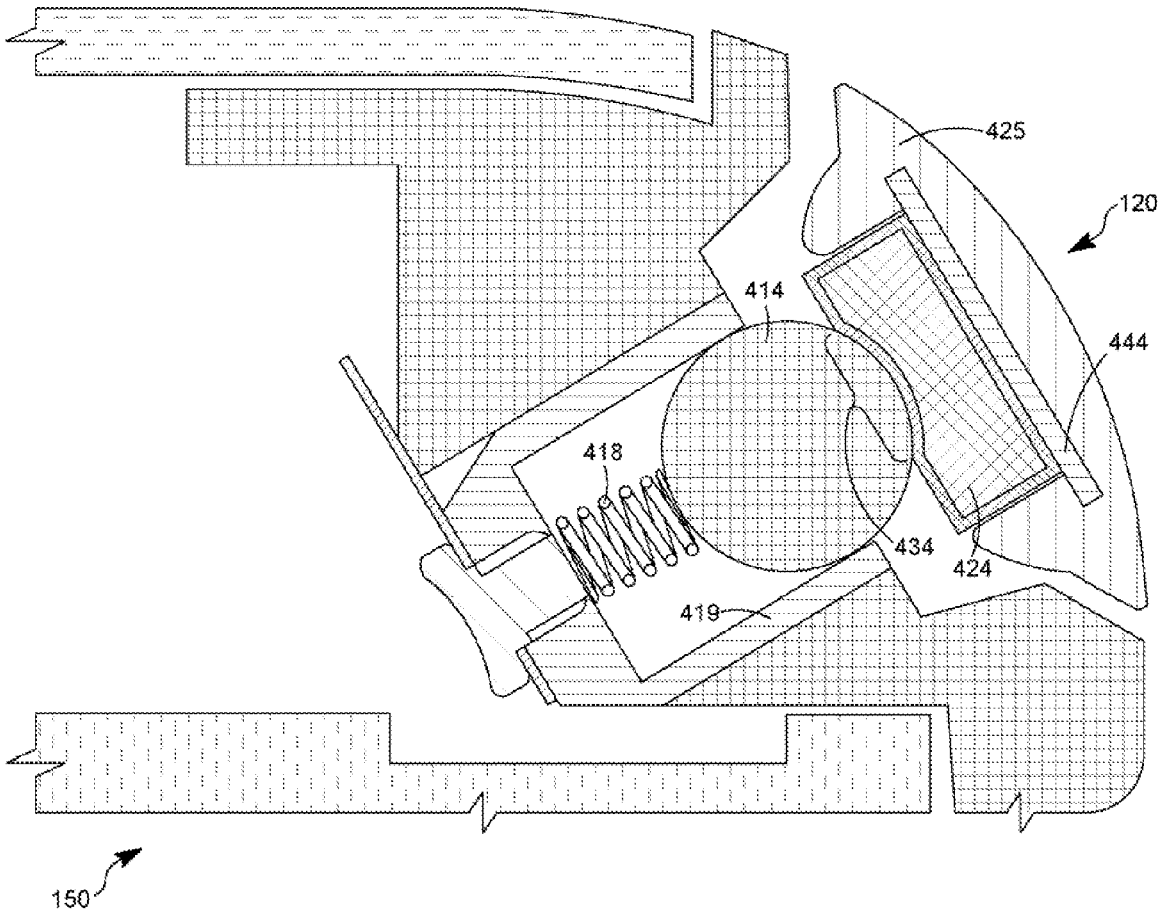
FIG. 4C illustrates a partial cross-sectional view of an electronic device with an antenna-carrying assembly in a stowed state in accordance with one or more embodiments of the present invention.

FIG. 4C illustrates a cross-sectional view of electronic device 150 with antenna-carrying assembly 120 in the stowed state illustrated in the example of FIG. 1A in accordance with one or more embodiments of the present invention. For example, FIG. 4C may represent cross-sectional view C as indicated in the example of FIG. 1A. In one or more embodiments, as illustrated in the example of FIG. 4C, electrical contact 414 may represent a ball element of a ball detent that includes a spring 418 and a barrel 419 configured to support/house electrical contact 414.

With the ball detent configuration, electrical contact 414 may be adjustable to one or more oblique points of contact on a second attraction element 424 of antenna-carrying assembly 120. Further, electrical contact 414 may be able to distribute force and distribute wear such that durability of electrical contact 414 may be advantageously improved.

Second attraction element 424 may include one or more magnetic/ferrous elements for magnetic coupling with electrical contact 414. Second attraction element 424 may also include a mating feature 434 configured to engage electrical contact 414. When antenna-carrying assembly 120 slides into the stowed state, the engagement of electrical contact 414 and mating feature 434 may provide an audible/acoustic and/or tactile confirmation to the user of electronic device 150. Mating feature 434 may also enhance the magnetic coupling between electrical contact 414 and second attraction element 424 by creating larger contact area between attraction elements. Electrical contact 414 may include one or more magnetic elements configured to reinforce the magnetic coupling between electrical contact 414 and second attraction element 424.

Antenna-carrying assembly 120 may include a shunt 444 insert-molded inside body 425. Shunt 444 may be configured to augment/tune the magnetic field of second attraction element 424. Shunt 444 may also be configured to secure second attraction element 424 in place through magnetic coupling, such that second attraction element 424 may be secured in place without relying on a complicated fastening mechanism or structure.

Figure 4D:
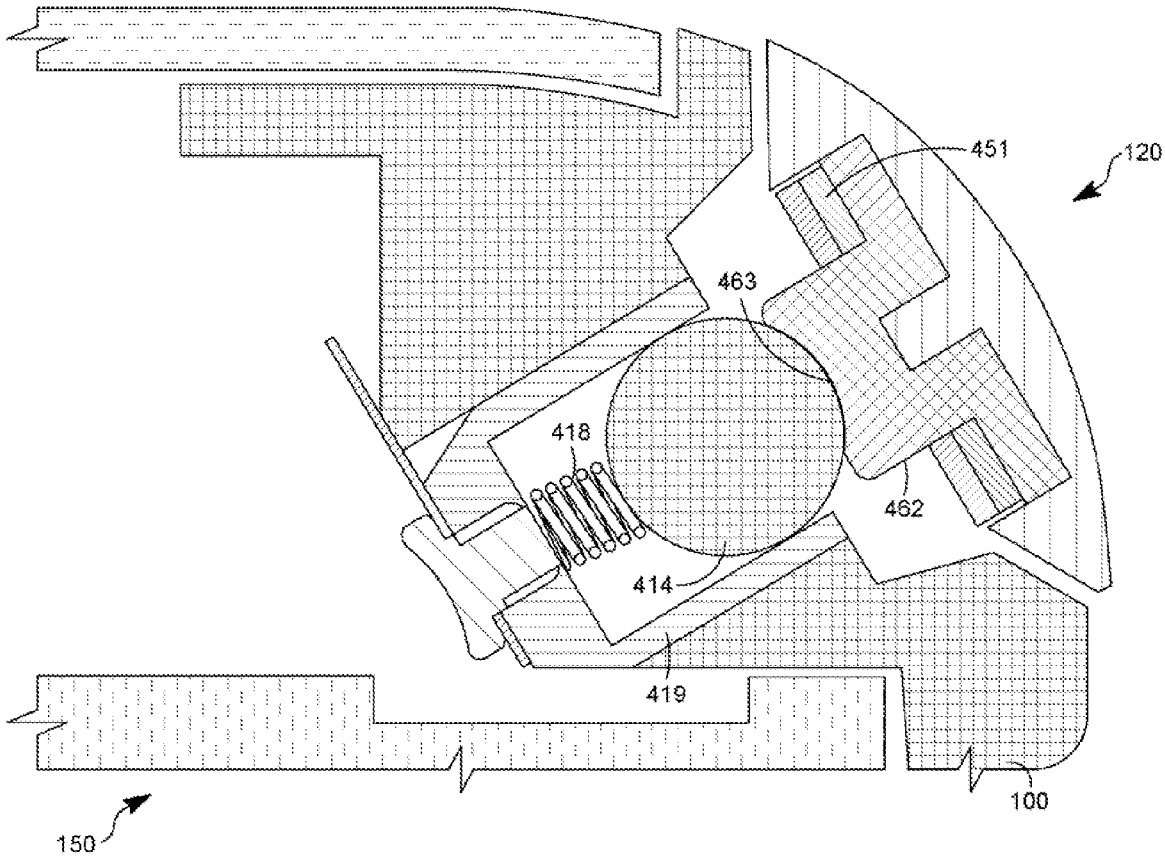
FIG. 4D illustrates a partial cross-sectional view of an electronic device with an antenna-carrying assembly in a deployed state in accordance with one or more embodiments of the present invention.

FIG. 4D illustrates a cross-sectional view of electronic device 150 with antenna-carrying assembly 120 in the deployed state illustrated in the example of FIG. 1B in accordance with one or more embodiments of the present invention. For example, FIG. 4D may represent cross-sectional view D indicated in the example of FIG. 1B.

As illustrated in the example of FIG. 4D, antenna-carrying assembly 120 may include tap element 462 contacting the one or more antenna elements 451. In the deployed state, tap element 462 may also contact and electrically connect with electrical contact 414. Tap element 462 and electrical contact 414 may also make non-contact electrical connection, for example capacitive coupling across a distance through a gap or material. Accordingly, tap element 462 plays the role of an electrical bridge between the one or more antenna elements 451 and electrical contact 414.

Tap element 462 may include a mating feature 463 configured to engage electrical contact 414, which may directly or indirectly connect with enclosure 100 of electronic device 150. Tap element 462 and electrical contact 414 may be biased toward each other given the magnetic coupling between first attraction element 421 and track 112 illustrated in the example of FIG. 4A. Tap element 462 and electrical contact 414 may also include magnetic or attraction elements for magnetic coupling. Accordingly, tap element 462 and electrical contact 414 may serve as a mechanical bridge between antenna-carrying element 120 and enclosure 100.

In one or more embodiments, electrical contact 414 may have a ball detent configuration supported by spring 418 and housed by barrel 419. Spring 418 may bias electrical contact against tap element 462 to reinforce electrical coupling. Barrel 419 may be formed of a conductive material, such as brass plated with gold. Accordingly, barrel 419, electrical contact 414 and tap element 462 form part of the electrical path between the one or more antenna elements 451 and electrical circuitry inside electronic device 150.

With the ball detent configuration, electrical contact 414 may have self-cleaning capability such that contamination on the surface of electrical contact 414 may be minimized, and electrical contact 414 may efficiently and effectively conduct electrical signals. The force provided by spring 418 also ensures optimal contact between electrical contact and tap element 462 to reinforce the electrical conductivity. The ball detent configuration may also enable oblique mating and un-mating (e.g. not along axial direction), creating robust electrical contact for a broad range of mating conditions.

Figure 5A:
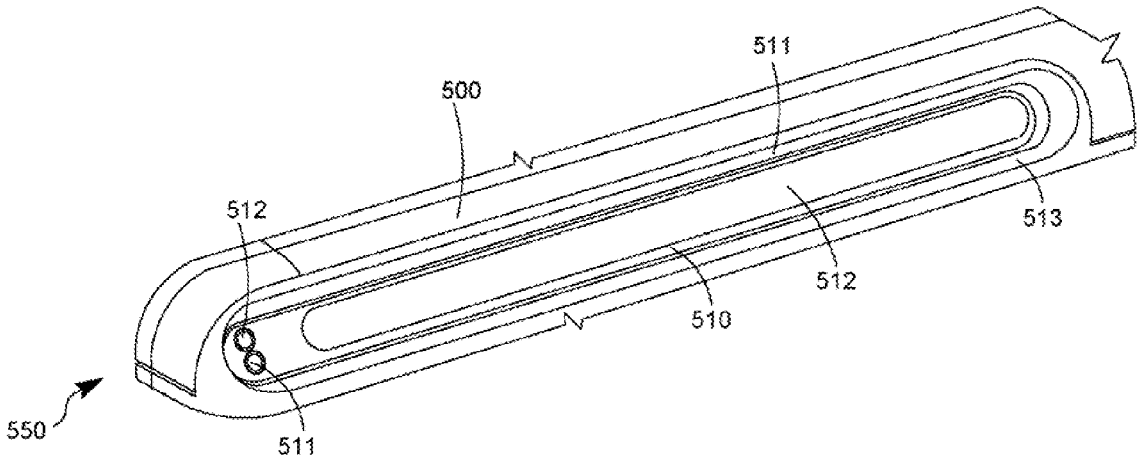
FIG. 5A illustrates a mating structure for accommodating an antenna-carrying assembly in accordance with one or more embodiments of the present invention.
Figure 5B:
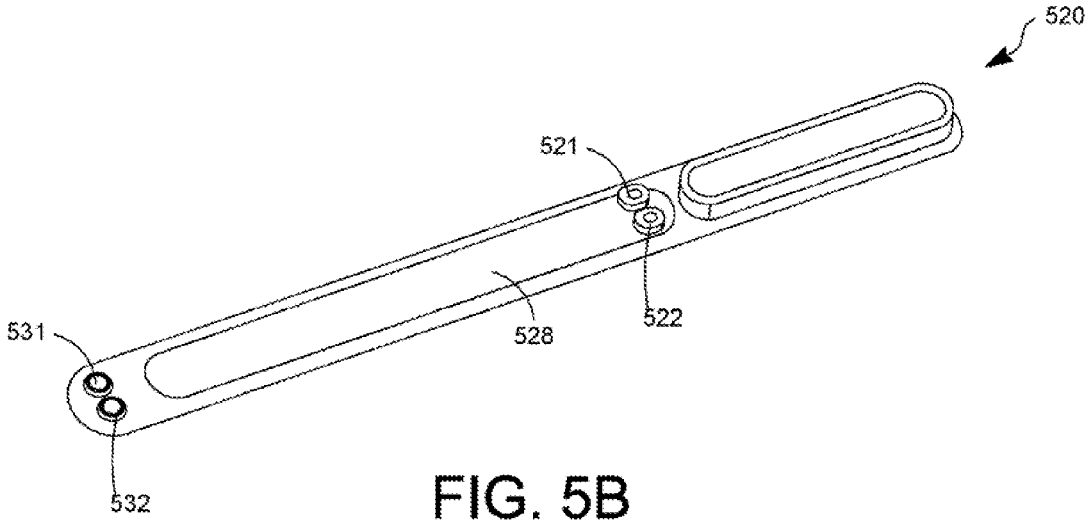
FIG. 5B illustrates an antenna-carrying assembly in accordance with one or more embodiments of the present invention.

FIG. 5A illustrates a mating structure 510 of an electronic device 550 for accommodating an antenna-carrying assembly in accordance with one or more embodiments of the present invention. FIG. 5B illustrates an antenna-carrying assembly 520 in accordance with one or more embodiments of the present invention. Antenna-carrying assembly 520 may be accommodated mating structure 510 in a stowed state. Antenna-carrying assembly 520 may be guided by at least one of track 512 and one or more of walls 511 and 513 of mating structure 510 when translating from the stowed state to a deployed state.

Mating structure 510 may include a plurality of electrical contacts, such as electrical contacts 511 and 512.

Antenna-carrying assembly 520 may includes a plurality of tap elements, such as tap elements 521 and 522, electrically coupled to one or more antenna elements 528, for example, for facilitating multi-band wireless communication. Tap elements 521 and 522 may be electrically (and magnetically) coupled to electrical contact 511 and 522, respectively, when antenna-carrying assembly 520 is in the deployed state.

Antenna-carrying assembly 520 may also include a plurality of tip attraction elements, such as attraction elements 531 and 532. Attraction elements 531 and 532 may be magnetically coupled to electrical contact 511 and 522, respectively, when antenna-carrying assembly 520 is in the stowed state, such that a tip of antenna-carrying assembly 520 may be secured and flush with an outer surface of enclosure 500 of electronic device 550.

As can be appreciated from the foregoing, embodiments of the present invention may optimize signal transmission and reception efficiency in wireless communication, based on one or more novel features. For example, embodiments of the invention optimally position antenna-carrying assemblies (and therefore antennas) such that obstruction of signal transmission and reception by a table (and/or a metal enclosure of an electronic device) may be minimized. Advantageously, embodiments of the invention may enable utilization of metal material in electronic device enclosures because the obstruction of the enclosure to an antenna may be minimized when an antenna-carrying assembly is in a deployed state.

Embodiments of the present invention may also provide a reliable electrical path reinforced by magnetic coupling and/or force applied by a spring. With magnetic coupling, embodiments of the invention may also prevent damages to electronic devices and antenna-carrying assemblies, since an antenna-carrying assembly may readily break away from a mating portion of an electronic device when a force is undesirably exerted on the antenna-carrying assembly. With magnetic coupling, embodiments of the present invention also enable easy replacement of antenna-carrying assemblies.

Keeping an antenna-carrying assembly flush with an enclosure of an electronic device when the antenna-carrying assembly is in a stowed state, embodiments of the present invention may provide space efficiency, and convenience in stowing electronic device. Embodiments of the present invention may also meet aesthetic/cosmetic requirements in electronic device design.

Embodiments of the present invention may be intuitive for a user to operate. Assisted by acoustic/tactile features, a user may find it very easy and convenient to slide an antenna-carrying assembly between a stowed state and a deployed state. The antenna-carrying assembly may be readily available with an electronic device whenever wireless communication is needed. A user may also find it very easy and convenient to reinstall the antenna-carrying assembly if the antenna-carrying assembly breaks away from a mating structure of the electronic device.

While this invention has been described in terms of several embodiments, there are alterations, permutations, and equivalents, which fall within the scope of this invention. It should also be noted that there are many alternative ways of implementing the methods and apparatuses of the present invention. Furthermore, embodiments of the present invention may find utility in other applications. The abstract section is provided herein for convenience and, due to word count limitation, is accordingly written for reading convenience and should not be employed to limit the scope of the claims. It is therefore intended that the following appended claims be interpreted as including all such alterations, permutations, and equivalents as fall within the true spirit and scope of the present invention.

What is claimed is:

1. An antenna-carrying assembly for facilitating wireless communication using an electronic device, the antenna-carrying assembly comprising:

a body;

one or more antenna elements carried by the body; and a first attraction element carried by the body, wherein the first attraction element is configured to magnetically couple the antenna-carrying assembly with a track and to slide along the track, and at least one of the first attraction element and the track includes one or more magnetic elements.

2. The antenna-carrying assembly of claim 1 wherein the track is disposed in a mating structure configured to accommodate the antenna-carrying assembly.

3. The antenna-carrying assembly of claim 1 wherein each of the first attraction element and the track includes one or more magnetic elements.

4. The antenna-carrying assembly of claim 1 wherein the track includes a plurality of discretely distributed attraction elements.

5. The antenna-carrying assembly of claim 1 further comprising a second attraction element carried by the body and configured to magnetically couple a tip of the antenna-carrying assembly to an electrical contact of the electronic device when the antenna-carrying assembly in a stowed state.

6. The antenna-carrying assembly of claim 1 further comprising one or more tap elements electrically coupled with the one or more antenna elements and configured to electrically couple the one or more antenna elements to one or more electrical contacts of the electronic device when the antenna-carrying assembly has slid to a deployed state.

7. The antenna-carrying assembly of claim 6 wherein at least one of the one or more tap elements and the one or more electrical contacts of the electronic device are configured to produce at least one of an acoustic signal and a tactile signal when the one or more antenna elements are electrically coupled with the one or more electrical contacts of the electronic device.

8. The antenna-carrying assembly of claim 6 wherein the one or more tap elements are configured to stop the antenna-carrying assembly from sliding in at least one direction.

9. The antenna-carrying assembly of claim 1 further comprising a shunt element carried by the body and configured to tune a magnetic field of the first attraction element and to secure the first attraction element in place.

10. The antenna-carrying assembly of claim 1 further comprising a holding structure configured to hole the first attraction element and to limit movement of the antenna-carrying assembly relative to the track.

11. The antenna-carrying assembly of claim 1 further comprising a tactile feature configured to enable the antenna-carrying assembly to be slid without being seen.

12. The antenna-carrying assembly of claim 1 wherein the one or more magnetic elements include one or more Halbach arrays.

13. The antenna-carrying assembly of claim 1 wherein a substantial portion of the antenna-carrying assembly is flush with at least a portion of an outer surface of an enclosure of the electronic device when the antenna-carrying assembly is in a stowed state.

14. An electronic device comprising:

a track; and an antenna-carrying assembly magnetically coupled with the track and configured to slide along the track, wherein the antenna-carrying assembly includes a body, one or more antenna elements carried by the body, and a first attraction element carried by the body, the first attraction element is configured to magnetically couple the an antenna-carrying assembly with the track, and at least one of the first attraction element and the track includes one or more magnetic elements.

15. The electronic device of claim 14 wherein the track is disposed in a mating structure configured to accommodate the antenna-carrying assembly.

16. The electronic device of claim 14 wherein each of the first attraction element and the track includes one or more magnetic elements.

17. The electronic device of claim 14 wherein the track includes a plurality of discretely distributed attraction elements.

18. The electronic device of claim 14 further comprising an electrical contact configured to magnetically couple to a second attraction element located at a tip of the antenna-carrying assembly when the antenna-carrying assembly in a stowed state.

19. The electronic device of claim 14 wherein the antenna-carrying assembly further includes one or more tap elements electrically coupled with the one or more antenna elements and configured to electrically couple the one or more antenna elements to one or more electrical contacts of the electronic device when the antenna-carrying assembly has slid to a deployed state.

20. The electronic device of claim 19 wherein at least one of the one or more tap elements and the one or more electrical contacts of the electronic device are configured to produce at least one of an acoustic signal and a tactile signal when the one or more antenna elements are electrically coupled with the one or more electrical contacts of the electronic device.

21. The electronic device of claim 19 wherein the one or more tap elements are configured to stop the antenna-carrying assembly from sliding in at least one direction.

22. The electronic device of claim 14 wherein the antenna-carrying assembly further includes a shunt element carried by the body and configured to tune a magnetic field of the first attraction element and to secure the first attraction element in place.

23. The electronic device of claim 14 wherein the antenna-carrying assembly further includes a holding structure configured to hold the first attraction element and to limit movement of the antenna-carrying assembly relative to the track.

24. The electronic device of claim 14 wherein the antenna-carrying assembly further includes a tactile feature configured to enable the antenna-carrying assembly to be slid without being seen.

25. The electronic device of claim 14 wherein the one or more magnetic elements include one or more Halbach arrays.

26. The electronic device or claim 14 wherein a substantial portion of the antenna-carrying assembly is flush with at least a portion of an outer surface of an enclosure of the electronic device when the antenna-carrying assembly is in a stowed state.

27. The electronic device of claim 14 wherein the track is disposed along an edge of the electronic device.

28. The electronic device of claim 14 wherein the track is disposed at a display module of the electronic device.

29. The electronic device of claim 14 further comprising at least one of a label and a coating disposed on at least one of the track and the first attraction element and configured to tune friction between the track and the first attraction element.

30. The electronic device of claim 14 further comprising one or more walls configured to stop the antenna-carrying assembly from moving in a dimension.

* * * * *

UNITED STATES PATENT AND TRADEMARK OFFICE

CERTIFICATE OF CORRECTION

PATENT NO. : 7,804,463 B2
APPLICATION NO. : 11/835944
DATED : September 28, 2010
INVENTOR(S) : Brett William Degner et al.

It is certified that error appears in the above-identified patent and that said Letters Patent is hereby corrected as shown below:

In column 1, line 60, delete “such,” and insert -- such --, therefor.

In column 2, line 17, delete “antenna-carrying,” and insert -- antenna-carrying --, therefor.

In column 2, line 34, delete “limitation” and insert -- limitation, --, therefor.

In column 3, line 26, delete “may,” and insert -- may --, therefor.

In column 4, line 16, delete “may,” and insert -- may --, therefor.

In column 7, line 50, delete “may,” and insert -- may --, therefor.

In column 10, line 17, delete “efficiency,” and insert -- efficiency --, therefor.

In column 11, line 25, in claim 10, delete “hole” and insert -- hold --, therefor.

In column 11, line 47, in claim 14, delete “the an” and insert -- the --, therefor.

Signed and Sealed this
Sixth Day of December, 2011

David J. Kappos

David J. Kappos
*Director of the United States Patent and Trademark Office*